US006763590B2

(12) United States Patent
Guimont et al.

(10) Patent No.: US 6,763,590 B2
(45) Date of Patent: Jul. 20, 2004

(54) RAZOR ASSEMBLY HAVING A CLUTCH CONTROLLED SHAVING AID DELIVERY SYSTEM

(75) Inventors: Raymond Guimont, Guilford, CT (US); Matthew Swanson, Mill Creek, WA (US); Ye Tao, Stanford, CA (US); Hao-Chih Liu, Stanford, CA (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/351,679

(22) Filed: Jan. 27, 2003

(65) Prior Publication Data

US 2004/0074097 A1 Apr. 22, 2004

Related U.S. Application Data

(60) Provisional application No. 60/420,275, filed on Oct. 21, 2002.

(51) Int. Cl.[7] ..... B26B 31/00
(52) U.S. Cl. ..... 30/41.5; 30/125
(58) Field of Search ..... 30/41.5, 41, 125, 30/345

(56) References Cited

U.S. PATENT DOCUMENTS 4,238,882 A 12/1980 Harrison, Sr.
4,270,268 A 6/1981 Jacobson
5,168,628 A 12/1992 Mock et al.
5,224,267 A 7/1993 Simms et al.
5,251,376 A 10/1993 Althaus et al.
5,253,420 A 10/1993 Althaus et al.
5,369,885 A 12/1994 Ferraro
5,384,961 A 1/1995 Gregory
5,416,974 A 5/1995 Wain

*Primary Examiner*—Charles Goodman
(74) *Attorney, Agent, or Firm*—McCormick, Paulding & Huber LLP

(57) ABSTRACT

A shaving aid delivery system for a razor assembly includes a cartridge assembly having a reservoir for storing a fluid shaving aid and skin care topicals, and channels for communicating the shaving aid to a shaving surface of the cartridge assembly. A spring driven piston assembly drives shaving aid from the reservoir to the shaving surface. A clutch assembly controls the movement of the piston assembly, the clutch assembly being movable between an engaged position wherein the movement of the piston assembly is prevented and a released position wherein the movement of the piston assembly is permitted. The clutch assembly is movable to the released position in response to a force applied to the shaving surface of the cartridge. A visual indicator alerts the user as to the amount of shaving aid remains in the reservoir and when replacement is due.

22 Claims, 10 Drawing Sheets

RAZOR ASSEMBLY HAVING A CLUTCH CONTROLLED SHAVING AID DELIVERY SYSTEM

CROSS REFERENCE TO RELATED APPLICATIONS

This application claims benefit under Title 35 U.S.C. §119(e) of U.S. Provisional Application Serial No. 60/420,275 filed Oct. 21, 2002, the disclosure of which is herein incorporated by reference.

BACKGROUND

1. Field of the Invention

The present disclosure relates to a shaving system having a fluid shaving aid, such as a skin lubricant, for improving the ease and comfort with which a razor can be drawn across the skin during the shaving process as well as providing skin care topicals. More particularly, the present disclosure relates to a shaving system having a clutch operated system for the controlled ejection of shaving aid.

2. Background of the Prior Art

It is known that many factors contribute to overall discomfort during the shaving process. Such factors include excessive frictional drag of the razor across the skin and the inflammation of the skin caused by various known epidermal conditions such as psoriasis, eczema, acne, skin rashes, etc. Efforts to address some of these factors have led to the use of pre-shave and/or after shave lotions which include emollients, beard softening agents, lathering agents, medicinal or soothing ointments, aloe, foam, soaps, and the like. Even though shaving comfort may be enhanced to some degree using emollients and other shaving aids, the requirement that they be applied before or after shaving tends to decrease their overall effectiveness and simply adds to the complications of the shaving process.

Shaving systems also use lubricants to decrease the frictional resistance during shaving. For example, static lubricating systems integrated with or attached to the razor cartridge are well known and help reduce the frictional drag of the razor as it is drawn across the skin. Such systems include lubricating strips affixed to the razor head proximate the razor cap portion. The lubricating strips typically include a water-insoluble polymer (such as polystyrene) and a water-soluble shaving aid such as polyethylene oxide, which gradually leaches out of the strip during shaving and reduces frictional drag. However, a problem with such systems is that the shaving aid leaches out in a skewed manner over time. At first, more than enough shaving aid leaches out. But after repeated use of the razor, less and less shaving aid leaches out. This results in the inefficient use of the limited quantity of shaving aid which can be incorporated into the lubricant strip. Moreover, the surface of the strip may become irregular and rough after repeated use, thereby increasing the coefficient of friction of the strip. This might contribute to further irritation of sensitive skin.

As a result, various attempts have been made to develop new systems for delivering shaving aid during the shaving process. However, such efforts have for the most part been only partially successful in their ability to consistently and evenly deliver shaving aid to the skin over time and repeated use of the razor.

Accordingly, there yet exists a need for a simple but effective shaving system which incorporates a system for effectively delivering a desired amount of shaving aid automatically or selectively by a user over the course of the normal and expected useful life of the razor blade.

SUMMARY OF THE INVENTION

A shaving aid delivery system for a razor assembly is provided herein. The shaving aid delivery system comprises a cartridge assembly having a reservoir for storing a fluid shaving aid, and means for communicating the shaving aid to a shaving surface of the cartridge assembly; (b) piston assembly movable from a first position to a second position for driving shaving aid from the reservoir to the shaving surface, the piston assembly being biased to the second position; (c) clutch assembly for controlling the movement of the piston means, the dutch assembly being movable between an engaged position wherein the movement of the piston assembly is prevented and a released position wherein the movement of the piston assembly is permitted, the clutch assembly being movable to the released position in response to a force applied to the shaving surface of the cartridge.

The shaving aid delivery system is advantageously responsive to the normal forces applied during the shaving process to delivery shaving aid to the shaving surface when needed.

BRIEF DESCRIPTION OF THE DRAWINGS

Various embodiments are described below with reference to the drawings wherein.

DETAILED DESCRIPTION OF PREFERRED EMBODIMENT(S)

In the following description, such terms as "distal" and "proximal", "upper" and "lower", and the like, are used relative to each other and not to any external fixed frame of reference. The term "distal" refers to the operating end of the razor instrument, and the term "proximal" refers to the handle end.

Figure 1:
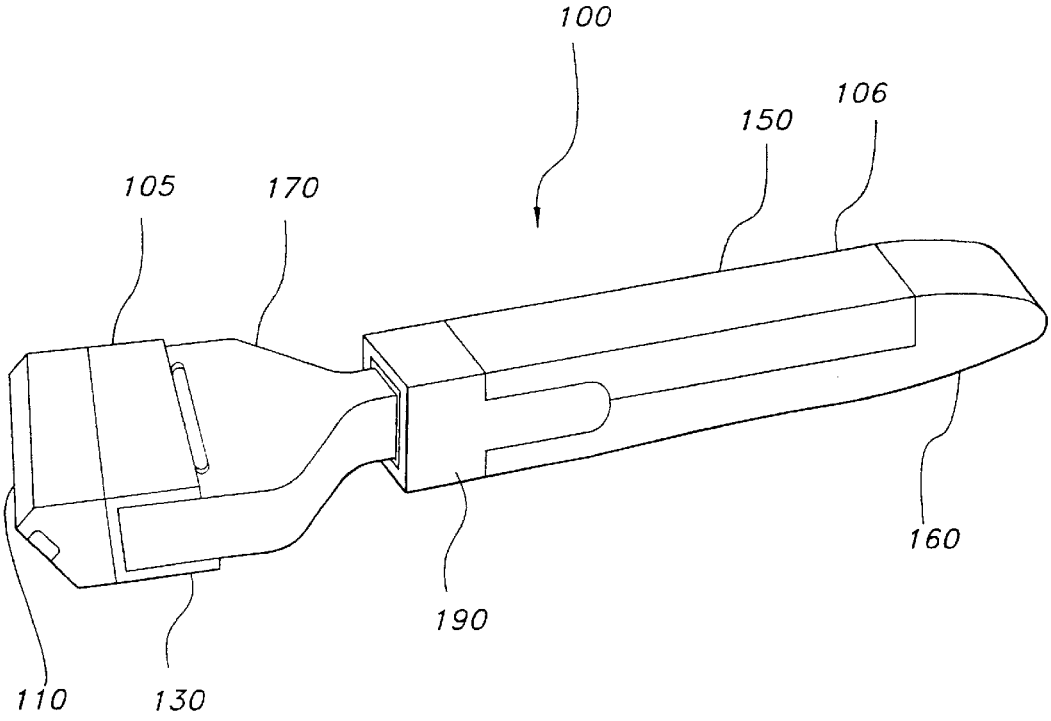
FIG. 1 is a perspective view of the razor assembly of the present invention.
Figure 2:
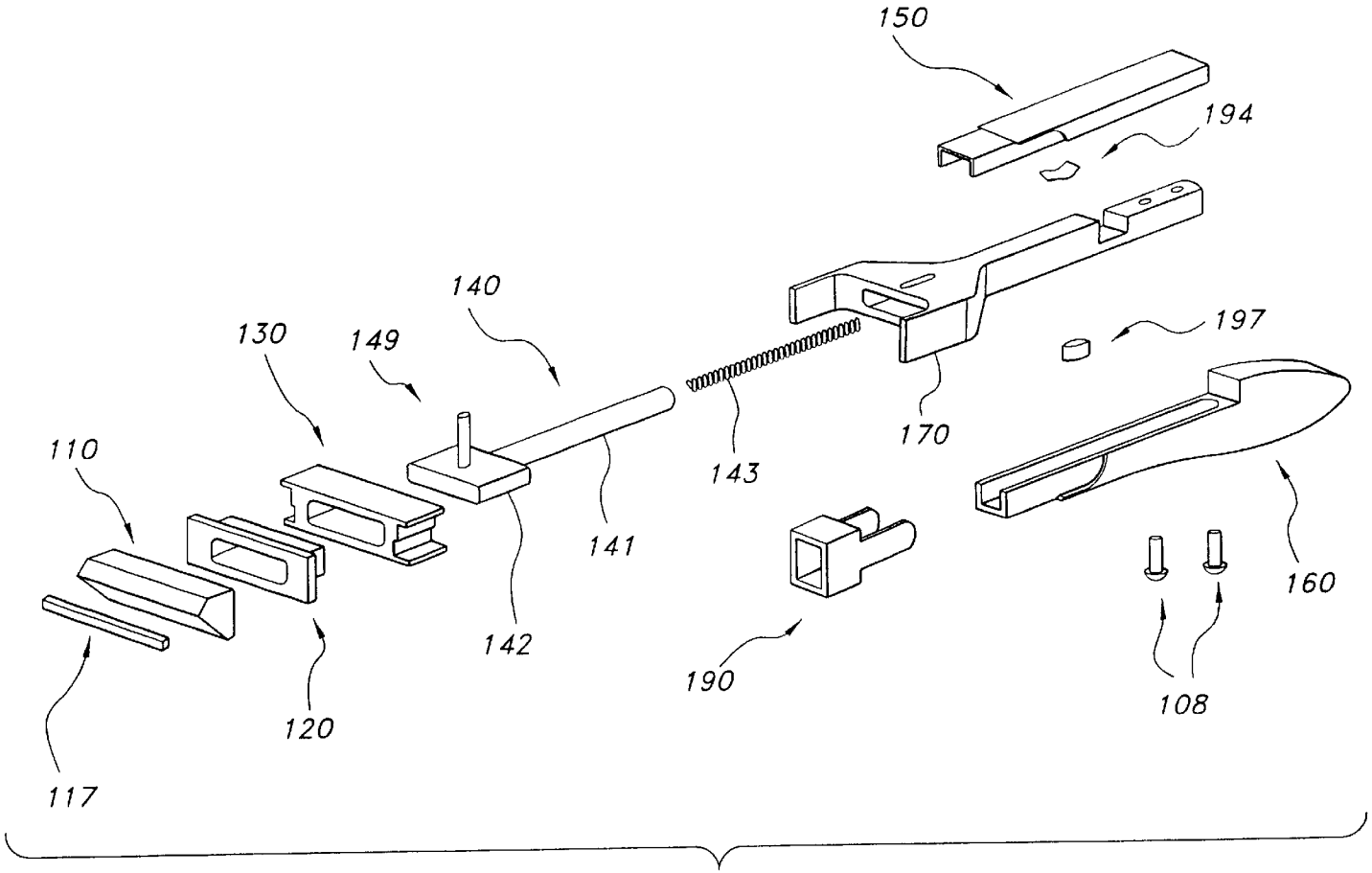
FIG. 2 is an exploded perspective view of the razor assembly.

Referring now to FIGS. 1 and 2, the razor assembly 100 includes a cartridge assembly 105 at its distal end, a piston assembly 140, a yoke 170 secured to a handle 106, and a leaf spring 194, friction pad 197, fastening members 108 and other components as described herein. A significant feature of the invention is a clutch mechanism for controlling the delivery of shaving aid to the shaving surface in response to forces normally applied to the razor instrument during shaving. The clutch mechanism, described more fully below, includes the yoke 170, friction pad 197, and preferably the leaf spring 194.

Figure 3:
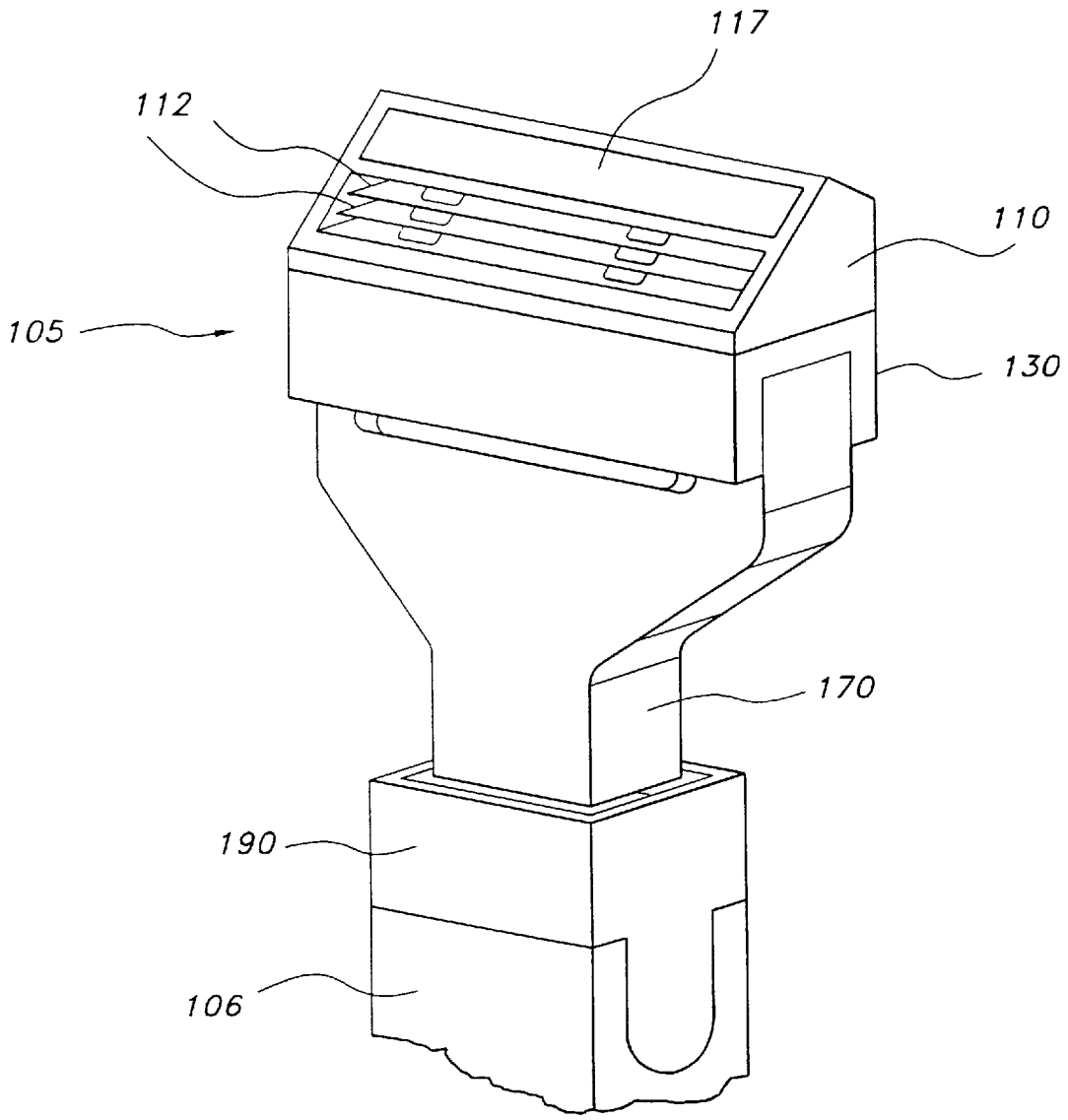
FIG. 3 is a perspective view of the distal portion of the razor assembly.
Figure 4:
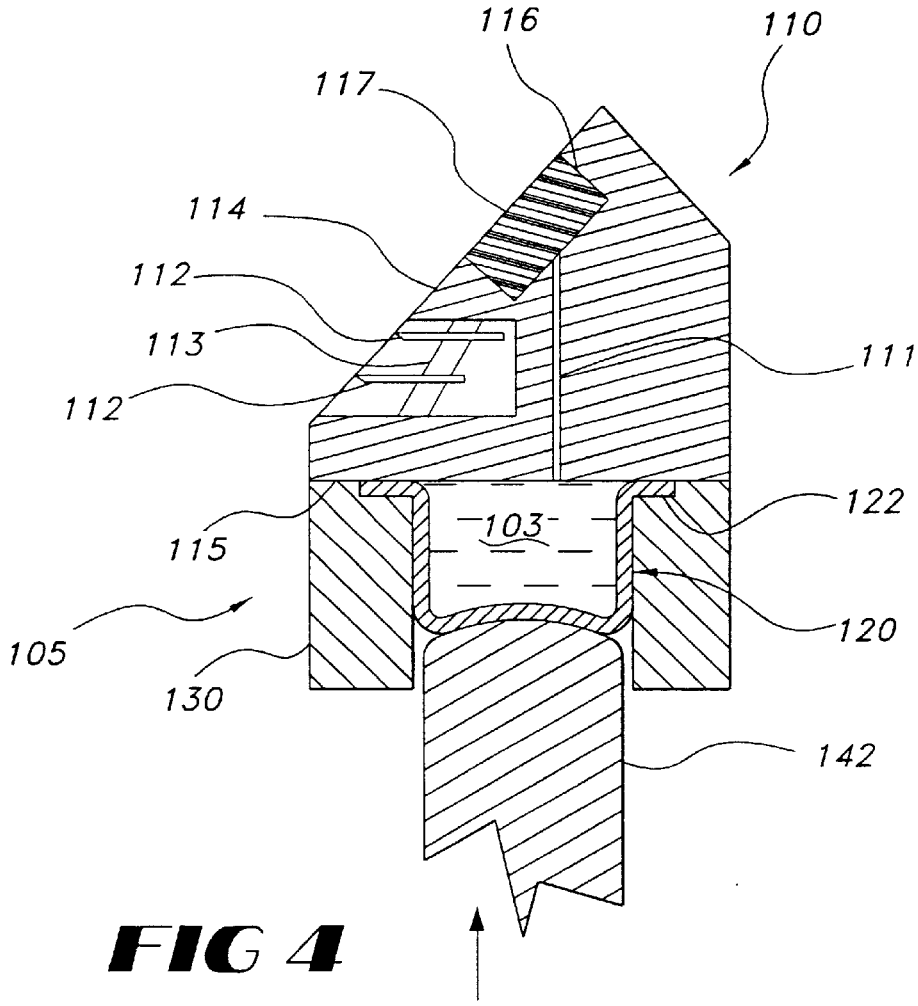
FIG. 4 is a sectional view of the cartridge assembly.
Figure 5:
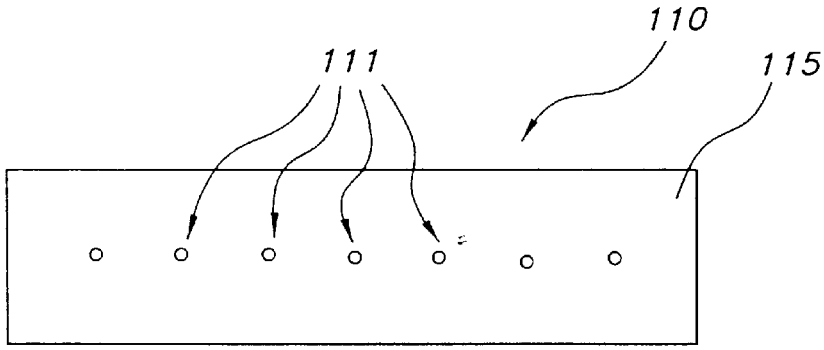
FIG. 5 is a plan view of the proximal surface of the cartridge head.

Referring now to FIGS. 3, 4 and 5, cartridge assembly 105 includes a cartridge head 110, a cartridge body 130, and a bladder 120.

Cartridge head 110 includes a shaving surface 114 and a proximal side 115. A recess 116 is adapted to receive a porous strip 117. Porous strip 117 is preferably a strip of material having a pore size ranging from about 1 to 100 microns, more preferably 2 to 50 microns, and most preferably from about 5 to about 20 microns, although pore sizes outside these ranges may also be used when appropriate. Preferably the porous strip 117 can be can be fabricated from an ultra-high molecular weight polyethylene and secured within recess 116 by a bonding agent such as cyanoacrylate adhesive. The porous strip 117 prevents environmental particles or other debris larger than the pore sizes from migrating into the supply of shaving aid. The porous strip 117 also limits the flow rate of shaving aid fluid out of the bladder and helps distribute the fluid across the shaving surface 114. As an alternative to a porous strip, strip 117 can be a oneway flow material which permits the flow of shaving aid to the shaving surface 114, but which does not permit backflow of fluid from the shaving surface into the supply of shaving aid. A plurality of channels 111 extend from the recess 116 to the proximal side 115 of the cartridge head. The channels 111 serve to communicate flow of shaving aid 103 from the bladder 120 to the porous strip 117.

Cartridge head 110 also includes one or more razor blades 112 and one or more supports 113 for the razor blades 112. Razor blade supports 113 can preferably be fabricated from a resilient material to permit the blades 112 to flex under the forces applied during shaving.

The flange 122 of the bladder 120 and the cartridge body 130 are preferably bonded to the proximal side 115 of the cartridge head by a bonding agent such as a cyanoacrylate adhesive. Alternatively a mechanical lock on the flange 122 can be employed to secure bladder 120.

Figure 6:
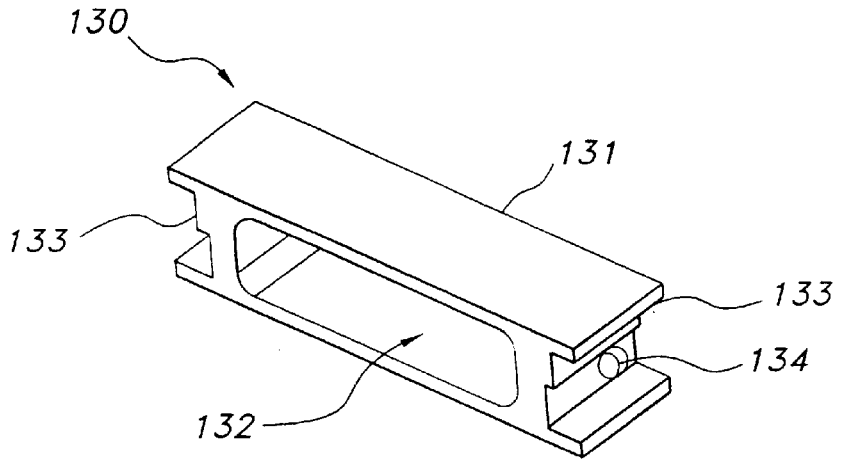
FIGS. 6 and 7 are, respectively, perspective and sectional views of the cartridge body.
Figure 7:
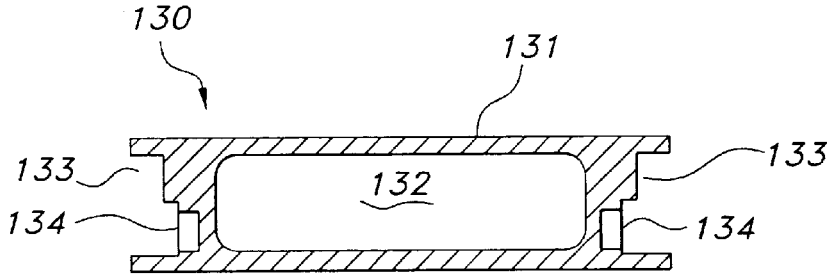

Referring now to FIGS. 3, 6 and 7, cartridge body 130 can be an elongated single piece member 131 fabricated from any suitable material, preferably a polymeric material such as acrylic, polycarbonate, polyvinyl chloride (PVC), acrylonitrile-butadiene-styrene (ABS), polypropylene, acetal, nylon or other engineering plastics. Cartridge body 130 includes an opening 132 for receiving and supporting the flexible bladder 120 described below. The sides of the cartridge body member 131 each include a slot 133 for receiving a respective one of the arms 176 of yoke 170 (FIG. 15), described below. Each slot 133 also includes a recess 134 for engaging a corresponding projection 179 on the respective arm 176 of yoke 170. The arms 176 flex to provide a snap-fit type of engagement with the cartridge body 130.

Figure 8:
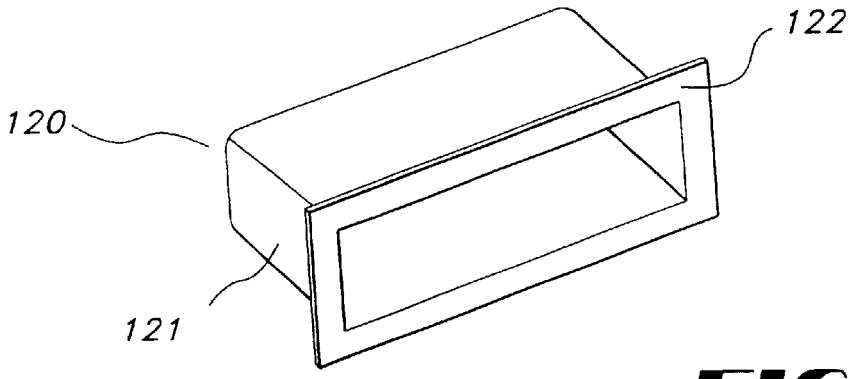
FIG. 8 is a perspective view of the bladder.

Referring to FIG. 8 the bladder 120 includes a pouch 121 and flange 122. The pouch 121 is for holding a desired amount of fluid shaving aid. The bladder 120 is preferably made from latex or other pliable, fluid-impervious material and is flexible to allow for collapse of the pouch as fluid shaving aid is ejected.

As used herein, the term "shaving aid" refers to a large variety of known shave-facilitating agents and skin care topicals which can include one or more combinations of the following substances:

- A lubricating agent for reducing the frictional forces between the razor and the skin, e.g., a silicone oil;
- An agent which reduces the drag between the razor pats and the surface being shaved, e.g., a polyethylene oxide in the range of molecular weight between 100,000 and 6,000,000; a non-ionic polyacrylamide; and/or a natural polysaccharide derived from plant materials such as "guar gum";
- An agent which modifies the chemical structure of the hair to allow the razor blade to pass through the whiskers very easily, e.g., a depilatory agent;
- A cleaning agent which allows the whisker and skin debris to wash more easily from the razor parts during shaving, e.g., a silicone polyethylene oxide block copolymer and detergent such as sodium lauryl sulphate;
- A medicinal agent for killing bacteria, or repairing skin damage and abrasions;
- A cosmetic agent for softening, smoothing, conditioning or improving the skin.
- A blood coagulant for the suppression of bleeding that occurs from nicks and cuts;
- Essential oils;
- Vitamin E, e.g., in a formulation of vitamin E acetate, sodium pyruvate, and sunflower oil, contained on a polytrap bead carrier;
- Synthetic moisturizers, lubricants, emollients, e.g., Dimethicone, $C_{12}$–$C_{15}$ alcohol benzoates, glycerin, cetyl alcohol and stearyl alcohol;
- Natural moisturizers, lubricants, emollients, e.g., jojoba oil, allantoin, Aloe Vera and sesame oil.

Figure 9:
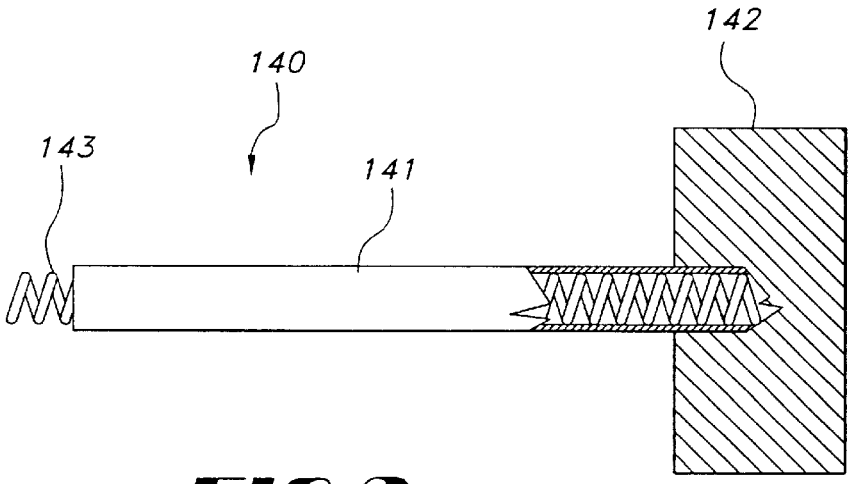
FIG. 9 is a partially cut away view illustrating the piston assembly.
Figure 10:
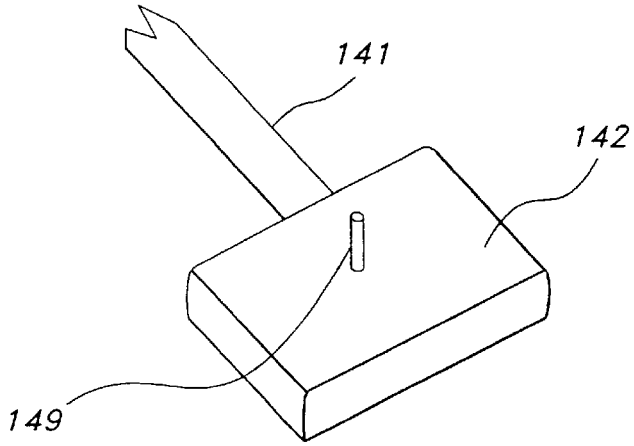
FIG. 10 is a perspective view of the distal end portion of the piston assembly.

Referring now to FIGS. 2, 9 and 10, piston assembly 140 includes a longitudinally extending tube 141 attached to a plunger 142. A helical compression spring 143 extends through the axial bore of tube 141 and provides a biasing force to move the plunger 142 distally through the razor assembly 100 when the friction pad is disengaged as described below. Plunger 142 can be fabricated from any suitable material, preferably an engineering plastic such as acrylic, polycarbonate, acetal, nylon and the like. A pin 149 extends laterally from the plunger 142 and is disposed through elongated slot 177 in the yoke 170, as described below in connection with FIG. 15. Pin 149 serves as a visual indicator for showing how much of the shaving aid has been used, and also as a stop member to prevent further distal movement of the plunger 142. Optionally, the yoke can include indicia alongside slot 177 to provide the user with a measure of the remaining amount of shaving aid (e.g., "¾ full", "half full", "¼ full", and "empty") to alert the user as to when replacement is due.

Figure 11:
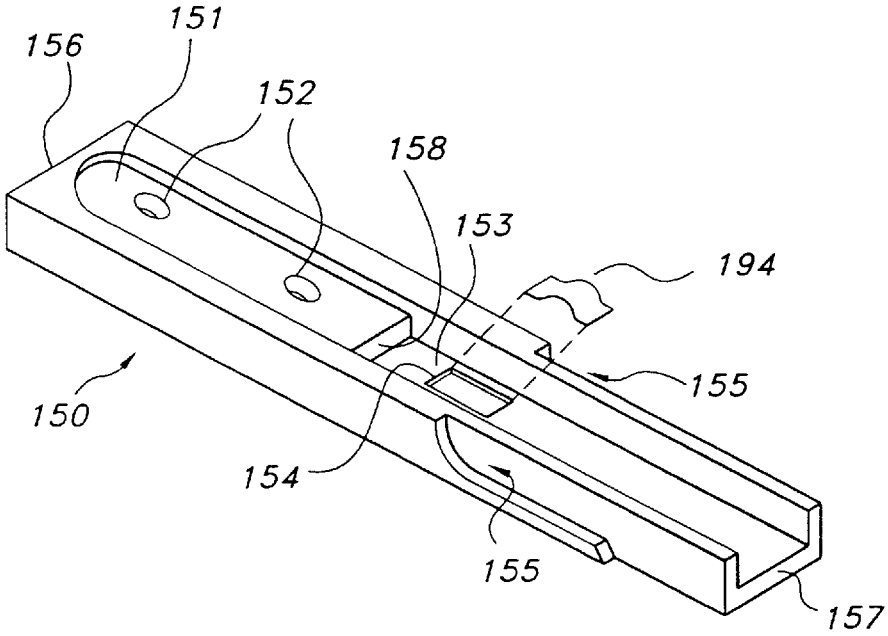
FIG. 11 is a perspective view of the first handle part.
Figure 12:
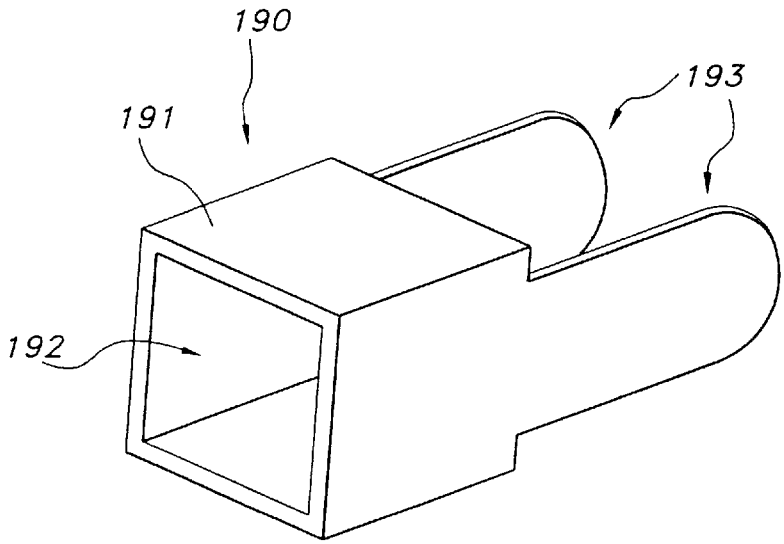
FIG. 12 is a perspective view of the collar.
Figure 15:
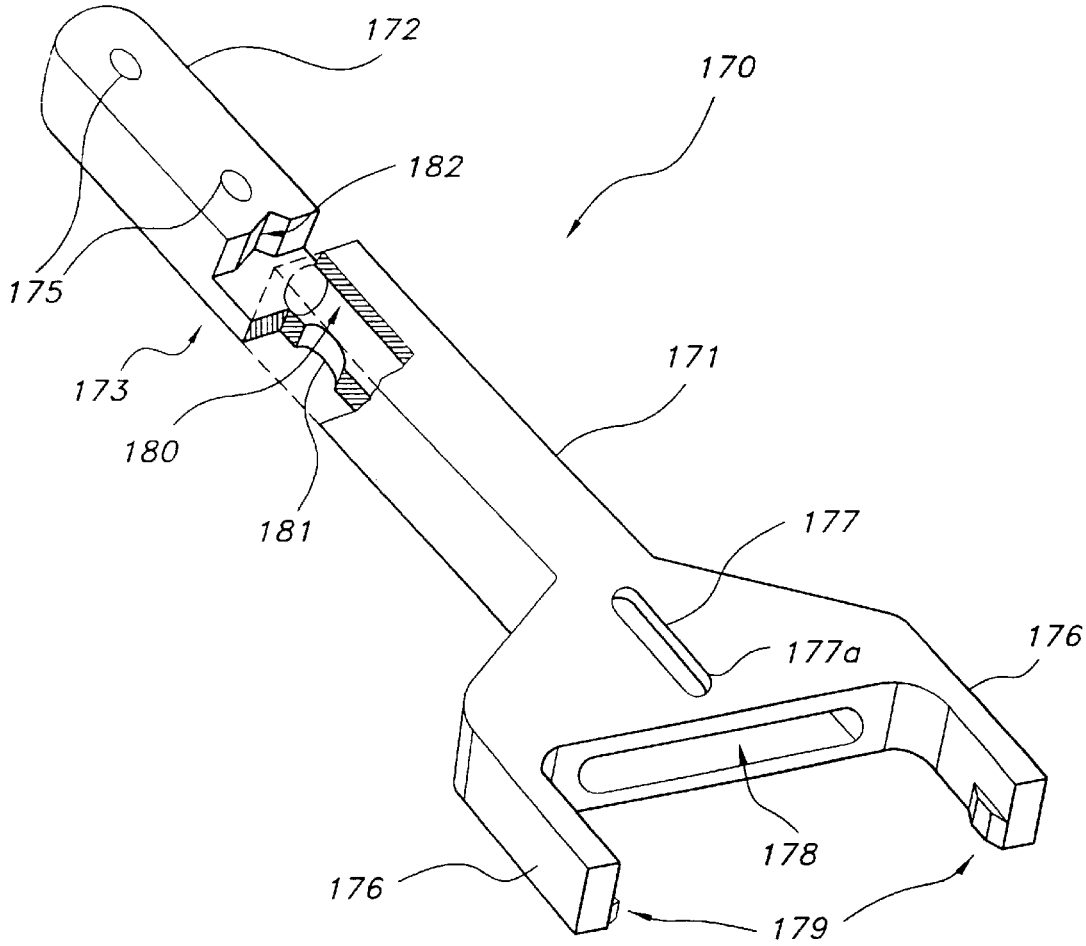
FIG. 15 is a partially cut away perspective view of the yoke.

Referring now to FIGS. 2 and 11, handle 106 includes a first handle part 150 jointed to a second handle part 160. The first handle part 150 is an elongated member, preferably fabricated from an engineering plastic as mentioned above, or any other suitable material. Handle part 150 has a proximal end 156, a distal end 157 and includes a first recessed portion 151 and holes 152 for receiving fastening members 108. The use of fastening members is optional. Other methods of fixedly joining the handle parts can be used, such as adhesive bonding, solvent bonding, heat bonding, welding, and the like. Preferably, fastening members 108 are screw fasteners and holes 152 are tapped holes. Alternatively, fasteners 108 can be secured by bonding agents or other suitable means. The first recessed portion 151 is adapted to engage the proximal portion 172 of the yoke 170 (FIG. 15). A second recessed portion 153 is delimited by step 158. Second recessed portion 153 is adapted to receive the distal portion 171 of the yoke. A recess 154 in the second recessed portion 153 is adapted to receive leaf spring 194, which biases the distal portion 171 of the yoke into close engagement with friction pad 197, as described below. The sides of the first handle part 150 each have an external recess 155 configured to accommodate the ears 193 of the collar 190 (FIG. 12). The first handle part 150 is adapted to be joined to the second handle part 160.

Figure 13:
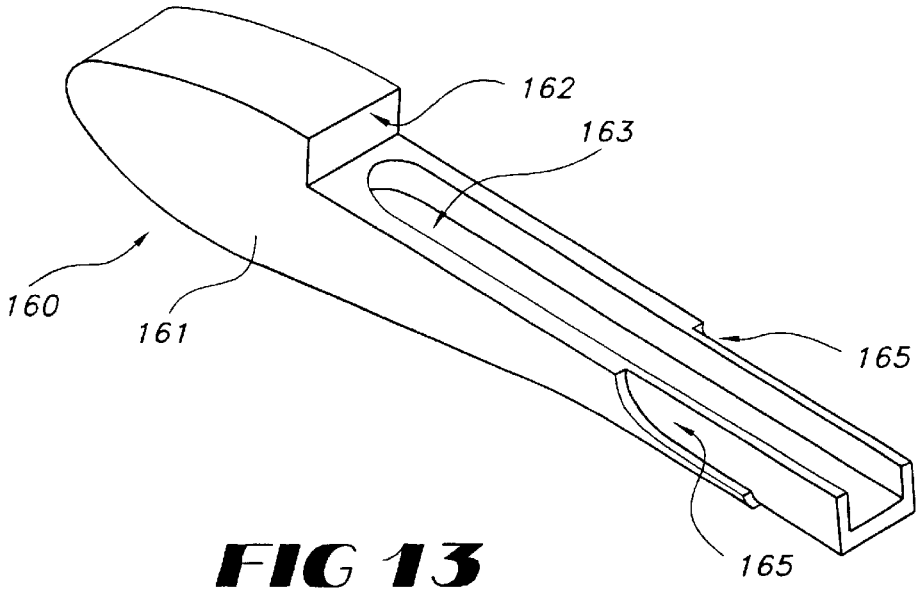
FIGS. 13 and 14 are, respectively, perspective and sectional views of the second handle part.
Figure 14:
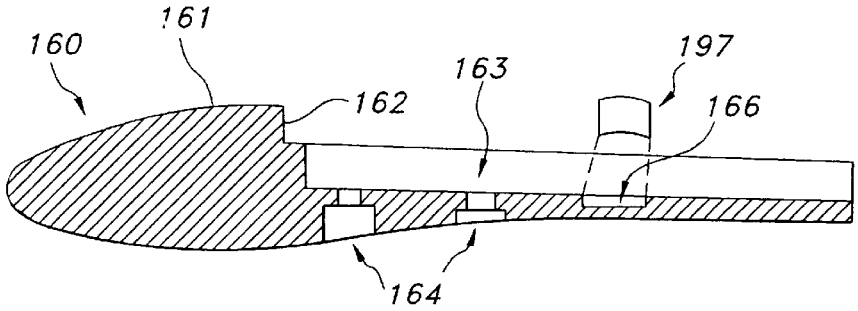

Referring now to FIGS. 2, 13 and 14, the second handle part 160 is an elongated member fabricated from any suitable material, such as an engineering plastic as described above. The second handle part 160 includes a proximal grip portion 161. A distally facing wall 162 is adapted to abut proximal end 156 (FIG. 11) of the first handle part 150 when the first and second handle parts are joined. A lengthwise extending recess 163 is adapted to receive the lengthwise extending portion of yoke 170.

The sides of the second handle part 160 each have an external recess 165 configured to accommodate the ears 193 of the collar 190. The second handle part includes holes 164 for reception therethrough of fastener members 108. Recess 166 is adapted to receive friction pad 197 which is secured therein by a bonding agent (e.g., an adhesive such as cyanoacrylate) or other suitable means. First handle part 150 and second handle part 160 are adapted to be joined together to form handle 106.

Friction pad 197 is preferably a resilient elastomeric material such as rubber which is configured and positioned to contact and frictionally engage the tube 141 of the piston assembly. The friction pad 197 constitutes a component of a clutch mechanism for the delivery of the shaving aid. The frictional engagement of the friction pad 197 against the tube 141 normally is sufficient to prevent distal advancement of the plunger 142. However, as explained more fully below, when the razor assembly is pressed against a surface (e.g., facial skin) for shaving, the yoke distal portion 171 flexes against the biasing force of leaf spring 194, thereby at least partially disengaging the clutch mechanism by reducing the frictional engagement of the friction pad 197 and tube 141. This action permits the distal advancement of the tube 141 and plunger 142 under the biasing force of spring 143 (FIG. 9).

Referring to FIGS. 2 and 15, yoke 170 is another component of the clutch mechanism. Yoke 170 is a generally Y-shaped member which includes a distal portion 171, a proximal portion 172, and a flex portion 173 between the distal and proximal portions 172 and 173. Proximal portion 172 includes holes 175 for the reception therethrough of fastener members 108. Recessed distal facing surface 182 provides a backstop for the proximal end of spring 143 (FIG. 9). The distal portion 171 includes an axial bore 180 through which tube 141 is slidably disposed. The friction pad 197 is disposed through aperture 181 for the purpose of contacting tube 141. The plunger 142 is slidably disposed in slot 178. Pin 149, which is fixedly attached to plunger 142, is disposed through longitudinal slot 177. As noted above, pin 149 gives visual indication of the amount of shaving aid used or remaining. The pin 149 also provides a stopping mechanism to resist further distal movement of plunger 142 when pin 149 reaches the distal end 177a of slot 177. The Y shaped distal end includes distally projecting spaced-apart arms 176. Each arm 176 includes an inner facing catch projection 179. The arms 176 are adapted to engage side slots 133 of the cartridge body by snap-fit engagement when the projections 179 snap into the corresponding recesses 134.

Referring now to FIGS. 1, 2, 3 and 12, collar 190 is a single piece member fabricated preferably from a plastic, which includes a distal portion 191 and ears 193 extending proximally from the distal portion 191. An aperture 192 extends through the,distal portion. The collar is adapted to fit around the distal end portion of the handle 106 when the handle parts 150 and 160 are joined. The collar 190 provides additional support to maintain the distal end portions of first and second handle parts 150 and 160 in close abutment with each other, but is an optional feature.

When the razor assembly 100 is not in use, the leaf spring 194 in the first handle part 150 biases the distal portion 170 of yoke 170 towards the second handle part 160. The friction pad 197 extends through aperture 181 so as to contact the outer surface of tube 141 and, by frictional engagement, to prevent distal movement of the piston assembly 140. However, when the razor assembly 100 is being applied to the skin for shaving, the pressure against the cartridge assembly 105 is transferred to yoke 170. The yoke flexes at the pivot region 173 such that the distal portion 171 of the yoke bends against the biasing force of leaf spring 194 away from the second handle part 160. The force which maintains the friction pad 197 in frictional engagement with tube 141 is thereby reduced sufficiently to allow the piston assembly to advance under the biasing force of spring 143. Advancement of the piston assembly 140 allows the plunger 142 to pressurize bladder 120, thereby forcing shaving aid 103 through channels 111 and porous strip 117 on to the shaving surface 114.

Figure 16:
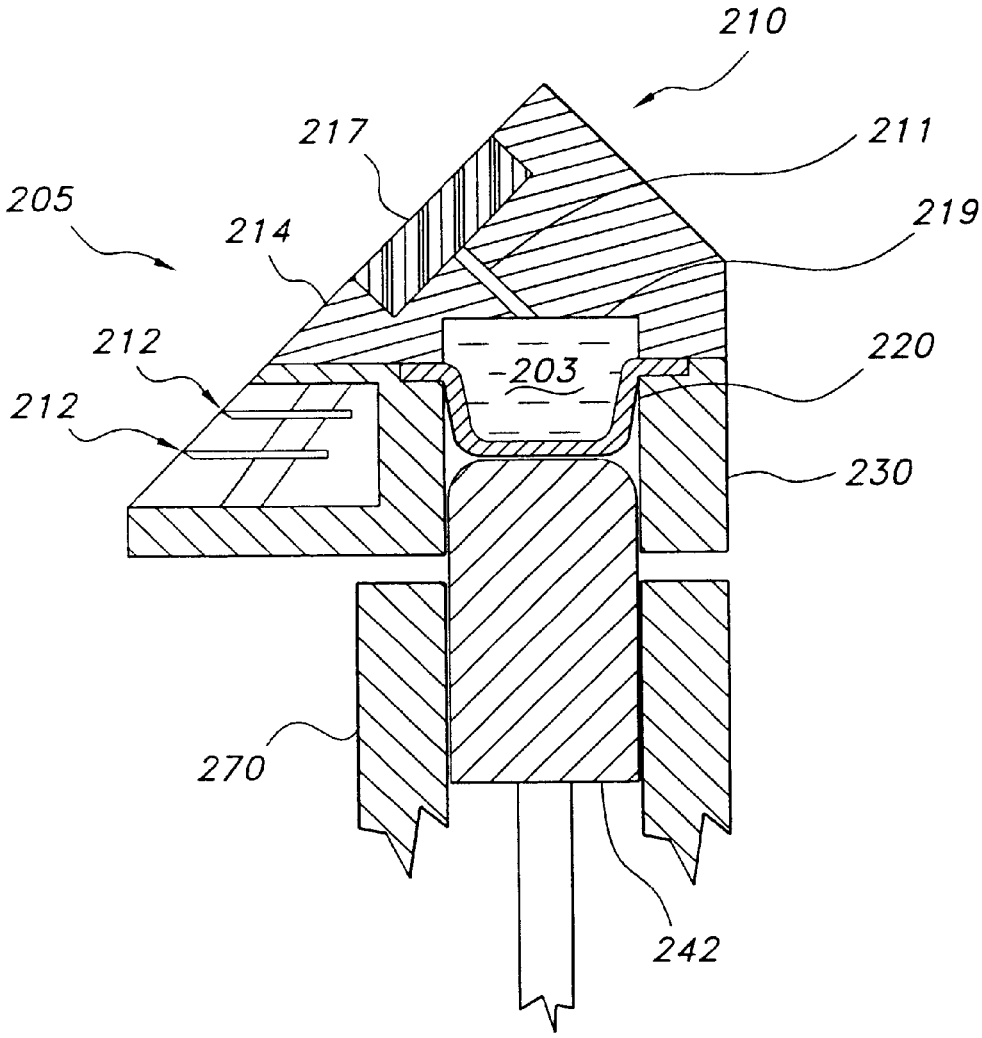
FIG. 16 is a sectional view of alternative embodiment of the cartridge assembly.

Referring now to FIG. 16, an alternative embodiment of the cartridge assembly is illustrated. Cartridge assembly 205 includes cartridge head 210 fixedly mounted to cartridge body 230. A plurality of channels 211 provide means for communicating shaving aid fluid 203 from a reservoir to porous strip 217. Bladder 220 is adapted to at least partially contain the shaving aid fluid 203. Plunger 242 slidably mounted within yoke 270 pressurizes the shaving aid fluid 203 by advancing against bladder 220 as described above with respect to razor assembly 100. The shaving aid fluid is thereby forced through channels 211 into porous strip 217 and thereafter onto the shaving surface 214. In contrast to the previously described embodiment of the cartridge assembly 105, the cartridge head 210 includes a recess 219 for at least partially defining the reservoir for containing the shaving aid 203. The channels 211 are relatively shorter than those of the previously described embodiment 111. Moreover, the razor blades 212 are mounted to the cartridge body 230.

While the above description contains many specifics, these specifics should not be construed as limitations on the scope of the invention, but merely as exemplifications of preferred embodiments thereof. Those skilled in the art will envision many other possibilities within the scope and spirit of the invention as defined by the claims appended hereto.

What is claimed is:

1. A shaving aid delivery system for a razor assembly, which comprises:

a) a cartridge assembly having a reservoir for storing a fluid shaving aid, and means for communicating the shaving aid to a shaving surface of the cartridge assembly;

b) piston assembly movable from a first position to a second position for driving shaving aid from the reservoir to the shaving surface, said piston assembly being biased to the second position;

c) clutch assembly for controlling the movement of the piston means, said clutch assembly being movable between an engaged position wherein the movement of the piston assembly is prevented and a released position wherein the movement of the piston assembly is permitted, said clutch assembly being movable to the released position in response to a force applied to the shaving surface of the cartridge; and d) a handle.

2. The shaving aid delivery system of claim 1 wherein the cartridge assembly includes a cartridge head, and a flexible bladder connected to the cartridge head for at least partially containing the shaving aid.

3. The shaving aid delivery system of claim 2 further including a porous strip mounted to the cartridge head.

4. The shaving aid delivery system of claim 2 wherein the cartridge assembly further includes a cartridge body for housing the bladder.

5. The shaving aid delivery system of claim 3 wherein the means for communicating the shaving aid to the shaving surface comprises at least one channel extending between the reservoir and the porous strip.

6. The shaving aid delivery system of claim 1 wherein the piston assembly includes a plunger attached to a tubular shaft.

7. The shaving aid delivery system of claim 6 wherein the piston assembly further includes a spring at least partially disposed through a bore of the tubular shaft.

8. The shaving aid delivery system of claim 1 further including a yoke for supporting the cartridge assembly, the yoke being mounted to the handle.

9. The shaving aid delivery system of claim 8 wherein the clutch assembly includes the yoke, a leaf spring and a friction pad.

10. The shaving aid delivery system of claim 9 wherein the yoke includes a distal portion, a proximal portion, and an intermediate flexible portion between the distal and proximal portions, wherein the proximal portion is fixedly secured to the handle, and the distal portion is pivotably movable from a first yoke position to a second yoke position in response to pressure applied to the cartridge assembly, wherein the friction pad frictionally engages the piston assembly to prevent movement of the piston assembly when the yoke is in the first yoke position, and wherein the friction pad does not prevent movement of the piston assembly when the yoke is in the second yoke position.

11. The shaving aid delivery system of claim 10 wherein the yoke is biased to the first yoke position by the leaf spring.

12. The shaving aid delivery system of claim 9 wherein the handle comprises a first handle joined to a second handle part.

13. The shaving aid delivery system of claim 12 wherein the leaf spring is attached to the first handle part and the friction pad is attached to the second handle part.

14. The shaving aid delivery system of claim 3 wherein the porous strip comprises a strip of synthetic polymer having a pore size of from 5 microns to 20 microns.

15. The shaving aid delivery system of claim 1 further including means for indicating an amount of shaving aid remaining in the reservoir of the cartridge assembly.

16. A razor assembly comprising:

a) at least one razor blade;

b) a fluid shaving aid;

c) a cartridge assembly having a support for mounting the at least one razor blade, a reservoir for storing the fluid shaving aid, and at least one channel for communicating the shaving aid from the reservoir to a shaving surface of the cartridge assembly;

d) piston assembly movable from a first position to a second position for driving shaving aid from the reservoir to the shaving surface, said piston assembly being biased to the second position;

e) clutch assembly for controlling the movement of the piston means, said clutch assembly being movable between an engaged position wherein the movement of the piston assembly is prevented and a released position wherein the movement of the piston assembly is permitted, said clutch assembly being movable to the released position in response to a force applied to the shaving surface of the cartridge; and f) a handle.

17. The razor assembly of claim 16 wherein the shaving aid includes one or more materials selected from the group consisting of silicone oil, polyethylene oxide, non-ionic polyacrylamide, guar gum, depilatory agent, a silicone polyethylene oxide block copolymer, sodium lauryl sulphate, antiseptic, skin conditioner, blood coagulant, vitamin E, sodium pyruvate, sunflower oil, Dimethicone, $C_{12}$–$C_{15}$ alcohol benzoate, glycerin, cetyl alcohol, stearyl alcohol, jojoba oil, allantoin, aloe vera and sesame oil.

18. The razor assembly of claim 17 wherein the clutch assembly includes a yoke for supporting the cartridge assembly, a leaf spring and a friction pad.

19. The razor assembly of claim 18 wherein the yoke includes a distal portion, a proximal portion, and an intermediate flexible portion between the distal and proximal portions, wherein the proximal portion is fixedly secured to the handle, and the distal portion is pivotably movable from a first yoke position to a second yoke position in response to pressure applied to the cartridge assembly, wherein the friction pad frictionally engages the piston assembly to prevent movement of the piston assembly when the yoke is in the first yoke position, and wherein the friction pad does not prevent movement of the piston assembly when the yoke is in the second yoke position.

20. The razor assembly of claim 19 wherein the yoke is biased to the first yoke position by the leaf spring.

21. The razor assembly of claim 20 further including indicator means for indicating the amount of fluid shaving aid remaining in the reservoir.

22. The razor assembly of claim 21 wherein the indicator means includes a member fixedly attached to the piston assembly and slidably disposed within an opening in the yoke.

* * * * *